SPINNING TOY

Applicant provides herein a toy which forms the basis of a game of skill. It is necessary, in order to score points in the game to spin a ball retaining element such that a ball provided therein will climb the sides of the unit and become lodged between the sides of the unit and a spinning member provided therein. This demands a certain degree of skill and points are awarded for lodging of the ball. The spinning device is shiftable within the retaining element such that the possible lodging position may be altered.

It is therefore an object of applicant's invention to provide a game-toy requiring the player thereof to lodge a ball member in certain positions to score points.

It is further an object of applicant's invention to provide a game-toy having means for positively positioning the same against a surface while the same is being played.

It is a further object of applicant's invention to provide a game-toy having a bowl-shaped, ball retaining member equipped with an internal spinning member and having a ball with a dimension that will allow the ball to be lodged between such spinning member and the ball retaining member.

It is a further object of applicant's invention to provide a game-toy having a bowl-shaped, ball-retaining member equipped with an internal spinning member which member is shiftable with respect to the center of the bowl to shift the position of lodgement of a ball between itself and the interior wall of the bowl.

It is still a further object of applicant's invention to provide a game-toy having a bowl-shaped, ball-retaining member having a plurality of compartments on the lower inner surface thereof for receiving and retaining a ball member therein.

These and other objects and advantages of applicant's invention will more fully appear from the accompanying disclosure made in connection with the accompanying drawings, wherein the same numerals are utilized to designate the same or similar parts throughout the several views, and in which.

Figure 1:
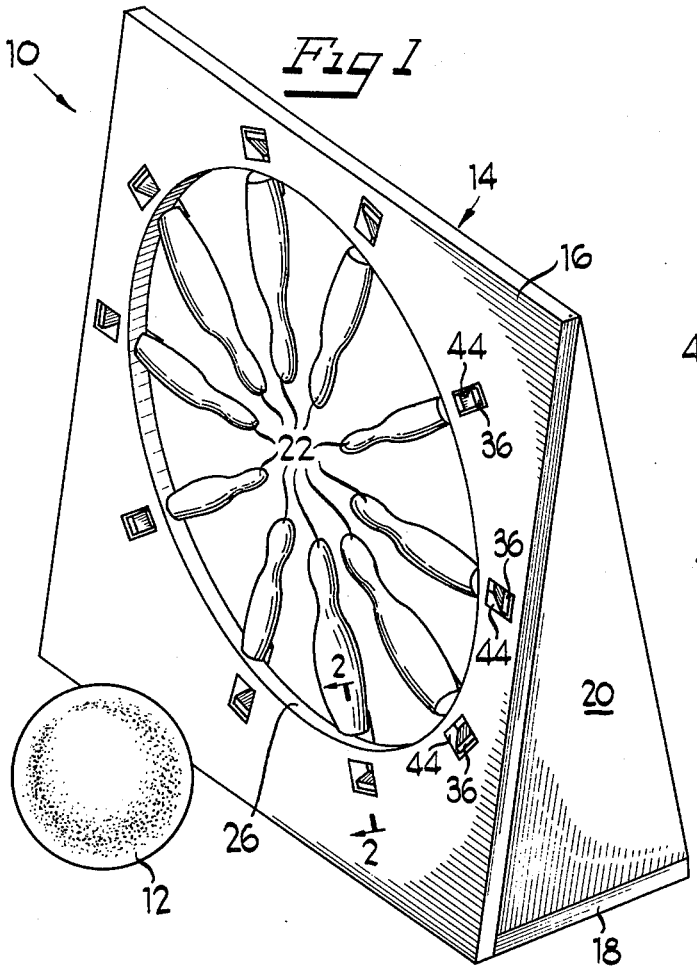
FIG. 1 is a perspective view of a spinning toy embodying the concepts of applicant's invention, illustrating the ball member thereof in a lodged, scoring position.
Figure 4:
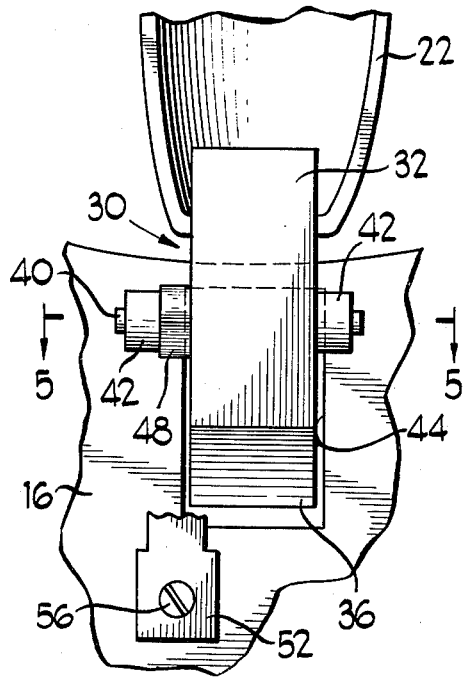
FIG. 4 is a side elevation of the toy.
Figure 5:
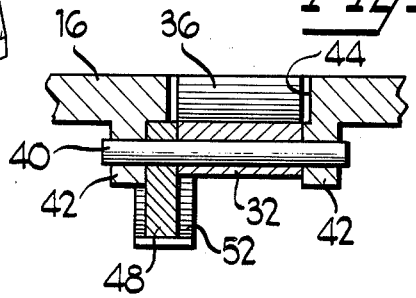
FIG. 5 is a section taken substantially along Line 5—5 of FIG. 4.
Figure 2:
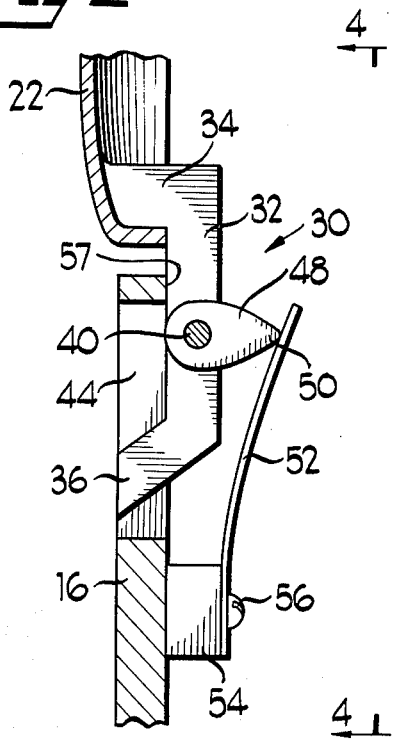
FIG. 2 is a top plan view thereof, illustrating the ball member thereof in lodged position through solid lines and in an alternative position through dotted lines.
Figure 3:
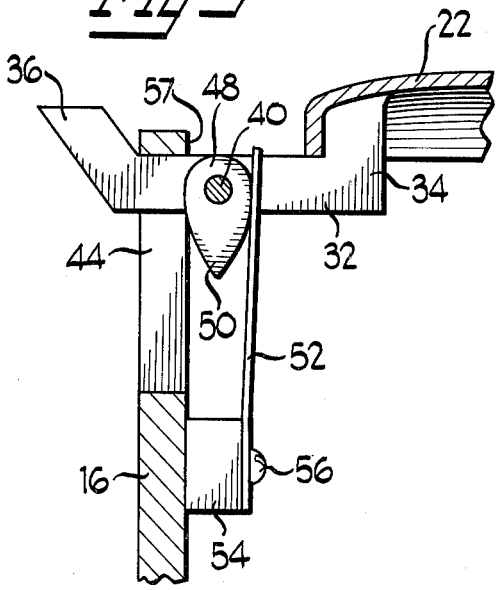
FIG. 3 is a vertical section taken substantially along Line 3—3 of FIG. 2 and again illustrating the ball in a solid and dotted line position.
Figure 1:
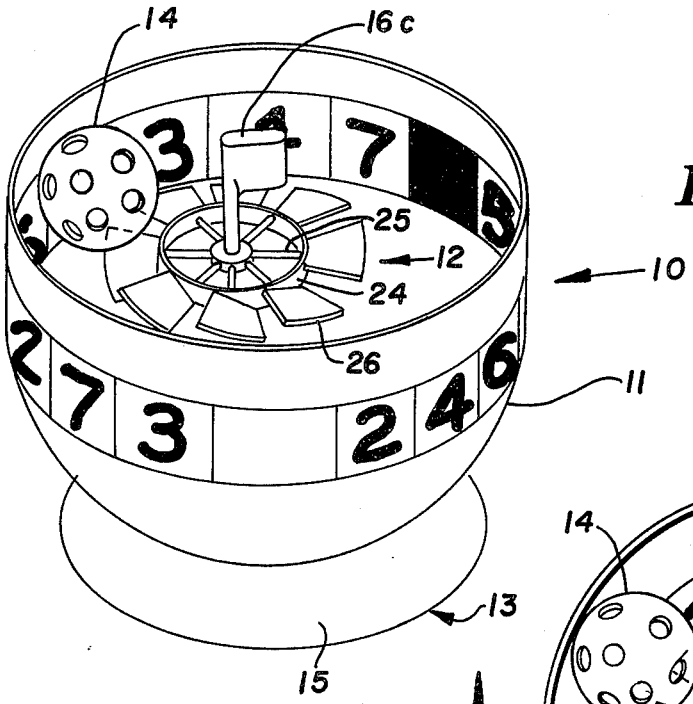
Figure 2:
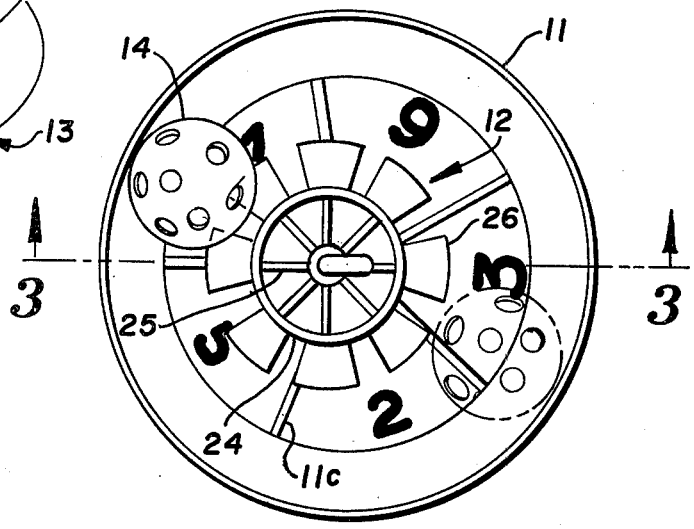
Figure 3:
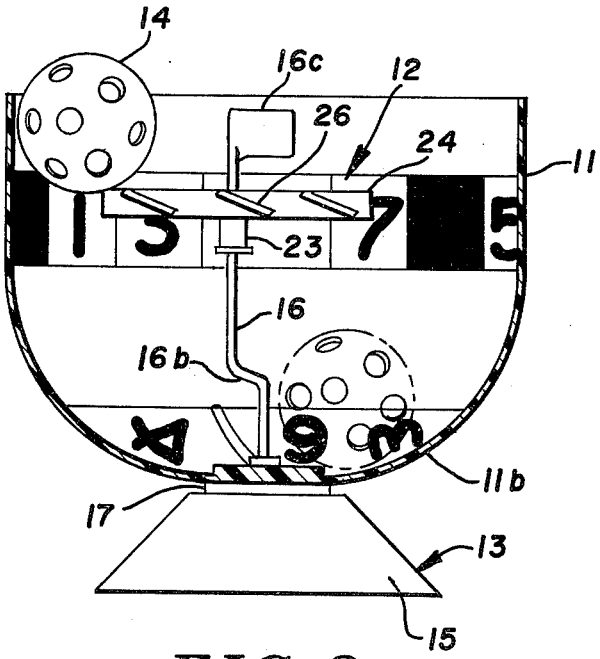
Figure 4:
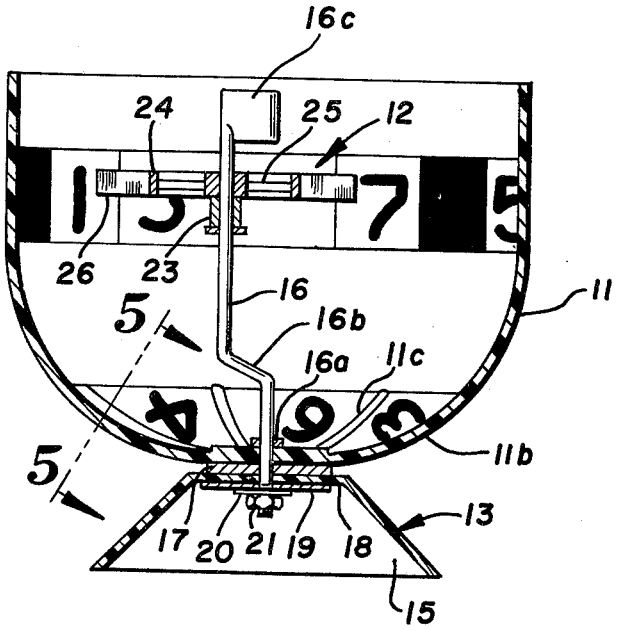
Figure 5:
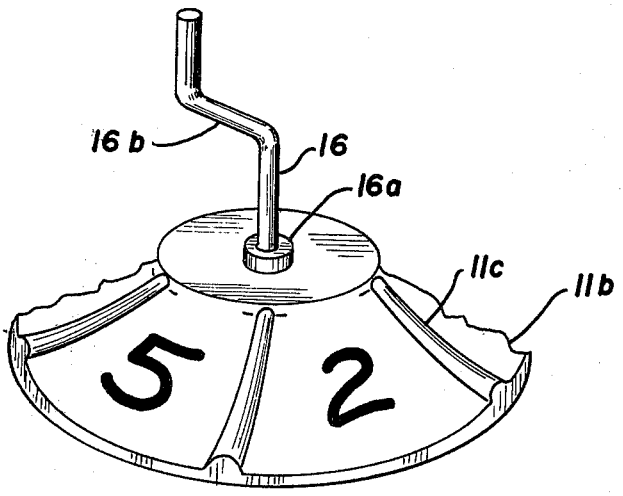

In accordance with the accompanying drawings, applicant's game-toy is generally designated 10 and basically includes a ball retaining, bowl member 11, a spinning lodging member 12, a suction, mounting member 13 and a ball member 14 with which the scoring for the game is accomplished.

The ball retaining bowl member 11 includes a generally semi-spherically shaped member having a portion 11*a* thereof extending generally vertically above what may be termed a mid-point of the sphere. The concept of this shape is to provide an interior surface that will permit the ball member 14 to be spun around the interior thereof and upon reaching a required predetermined speed, the ball member will climb the interior wall where it may become lodged between the wall and the spinner member 12.

The ball retaining bowl member 11 is provided with indicia about the periphery thereof generally level with the top of spinner 12 such that a scoring is provided. The scoring technique is determined by the position of lodgement of the ball 14 against the interior wall.

Arranged about the bottom 11*b* of the bowl 11 are a plurality of radially spaced rib members 11*c* which will provide a plurality of compartments for receiving the ball 14 therein should the same not be lodged as previously stated.

In use of the game-toy, the player will be given a predetermined amount of time to lodge the ball 14 between the spinner 12 and the wall of the retaining level 11 and if the same is not lodged, it will drop into one of the compartmented areas. These areas are also provided with indicia for scoring.

Means for mounting the game-toy are provided such that the same may be held to a surface through suction. This mounting means is designated 13 and basically includes a suction cup section 15 held to the outer surface of the bowl 11 through an attachment member 16 which extends downwardly through the bottom of the bowl 11, through a placement disc 17, the resilient top 18 of the suction cup 15, through an additional placement disc 19 and finally through a washer 20 and threaded attachment member 21. Obviously the end of attachment member 16 must be threaded for the totally fastening of the bowl 11 to the attachment member 13 and to accomplish the tightening of this assembly it may be necessary to provide a shoulder 16*a* on the attachment member of rod 16. With this mounting structure, it should be obvious that the bowl 11 may be releasably mounted upon a surface or the same may be spun while holding the same in one's hands.

The attachment member or rod 16 is, in the form shown, arranged generally centrally of the bottom of bowl 11 and is provided with a parallel offset 16*b* such that the axis provided by the rod 16 is off center with respect to the bowl 11. A tab 16*c* is provided at the upper end of rod 16 to permit grasping of the rod 16 for rotating the same with respect to the bowl 11. Obviously the mounting as previously discussed, must allow for this rotation and varied displacement.

The attachment member or rod 16 extends generally upwardly into the bowl 11 and is provided with a bushing member 23 at the upper end thereof for positioning of the spinner 12 thereon in substantial alignment with the indicia on the bowl 11. The spinner member 12, is, in the form shown, formed of a radially formed, ribbed member having a peripheral ring 24 at the outer end of such ribs 25 with a plurality of angularly arranged blade elements 26 extending outwardly from said ring 24 such that the ball member 14 is able to move upwardly between the ends of such blades 26, due to the angular positioning thereof and the placement of rod 16 and become lodged between the same and the inner surface of the bowl 11.

By shifting the rod 16, it should be obvious that the spinner 12 will be moved with respect to the wall of bowl 11 and the ball 14 will obviously lodge at the places where the spinner is closest to the wall. This then permits an opponent to present problems to the player. If the player needs a specific number to win a game, the opponent could so position the spinner so that no number on the wall, when the ball would lodge, will provide this score and the player would have to rely on the ball dropping into the numbered compartments at the bottom of the bowl rather than lodging the ball.

The ball member 14 is illustrated as having a plurality of holes 14*a* therethrough but these holes are not necessary to the operation of the invention and are rather shown to suggest that the ball 14 should be relatively light weight such that the same will more easily rise to lodging position when the bowl 11 is spun.

Preferably, the entire toy should be formed of a relatively light weight material and in the form that the applicant has found to be most acceptable, the bowl 11 is formed of a clear material.

The scoring and various indicia of the game may take many various forms. For example, one of the blades may be of solid color and additional points may be scored by lodging the ball 14 between this particular blade and one of the indicia on the wall of the bowl 11. These are aspects of playing the game and are not of any import to the structural aspects thereof.

In operation of the game-toy, the bowl may be either releasably mounted on a surface or the player may hold the same in his hands. Upon spinning of the bowl 11, the ball will move about the inner surface thereof while steadily climbing the wall and the spinner 12 will also be caused to rotate. Depending upon the skill of the player, the ball will ultimately climb to a position where it will pass upwardly over the blades 26 of the spinner 12 and this passing is permitted due to the particular dimensions of the ball 14, the diameter of the blades 26 and the inner diameter of the bowl, the angularity of the blades 26 with respect to the circumferential ring 24 and the positioning of the spinner as controlled by rod 16. As the ball tends to drop downwardly through the blades 26, the same will become lodged between the same and the inner surface of the bowl. At this point the player will cease to spin the bowl and the score is counted. If the player is not capable of lodging the ball when his turn has elapsed, the ball will drop into the compartmented area of the bottom of the bowl and again the score is calculated.

It should be obvious that the bowl must be designed to permit the ball to rise above the spinner blades and for this reason the applicant has chosen a shape and dimension over semi-spherical which will permit such movement.

It should be obvious that the applicant has provided a new and unique game-toy which relies upon the interaction of various members being spun and which also relies upon the proper sizing and positioning of the elements thereof to permit lodging of the elements.

What I claim is:

1. A spinning toy including:

a. a generally semi-sperhical bowl member having a portion thereof extending above the midpoint of the spherical portion thereof defining an interior, smoothly radiused wall portion;

b. a spinnable member having a plurality of equal length radially extending blade members, the radial dimensions of said blade members being less than the radial dimension of said interior wall portion;

c. means locating said spinnable member about an axis which is vertical and offset with respect to the vertical axis of the bowl member when the latter is disposed in an upright position;

d. a ball normally freely disposed in said bowl member below said spinnable member; and, e. said ball, blade member lengths and offset being so dimensioned as to allow the ball to move from the bottom of the bowl member past the spinnable member along a path defined by that part of said wall portion which is generally furthest removed from said axis and allow the ball to be supported conjointly by one or more blades and that part of said wall portion which is generally closest to said axis.

2. The structure set forth in claim 1 and a mounting rod for mounting said spinnable member, said rod arranged and constructed to position said spinnable member off center with respect to said bowl.

3. The structure set forth in claim 2 and said rod being shiftable whereby said spinnable member may be shifted with respect to said bowl.

4. The structure set forth in claim 1 and said spinnable member being arranged for rotation within said bowl member.

5. The structure set forth in claim 1 and said bowl member being provided with indicia around the periphery thereof in generally aligned relation to the location of said spinnable member.

6. The structure set forth in claim 1 and means for releasably attaching said bowl member to a surface.

7. The structure set forth in claim 6 and said attachment means including suction cup means attached to the outer lower portion of said bowl portion.

8. The structure set forth in claim 1 and said blade members being arranged on said spinnable member at an angular relation thereto.

9. The structure set forth in claim 8 and said blade members providing spacing to permit said ball member to pass between said blades and the interior of said bowl member.

10. The structure set forth in claim 1 and the bottom of said bowl member being compartmented to receive said ball therein.

11. The structure set forth in claim 1 and said bowl member being formed of a light passing material.

12. The structure set forth in claim 10 and said compartments being provided with indicia thereon.

* * * * *